United States Patent [19]

Ellcock

[11] Patent Number: 4,622,203

[45] Date of Patent: Nov. 11, 1986

[54] CONTAINER FOR IRRADIATED NUCLEAR FUEL

[75] Inventor: Glenn Ellcock, Ellesmere Port, England

[73] Assignee: British Nuclear Fuels Limited, Warrington, England

[21] Appl. No.: 420,348

[22] Filed: Sep. 20, 1982

[30] Foreign Application Priority Data

Oct. 26, 1981 [GB] United Kingdom ..... 8132241

[51] Int. Cl.[4] ..... G21C 19/00

[52] U.S. Cl. ..... 376/272; 220/20; 250/507.1

[58] Field of Search ..... 220/20, 20.5; 250/506.1, 507.1; 376/272, 283

[56] References Cited

U.S. PATENT DOCUMENTS

| | | | |
|---|---|---|---|
| 2,951,614 | 9/1960 | Greene | 220/20 |
| 3,276,965 | 10/1966 | Leyse | 376/283 |
| 3,521,745 | 7/1970 | Schwartzman | 220/20.5 |
| 4,252,611 | 2/1981 | Mizumachi et al. | 376/283 |

FOREIGN PATENT DOCUMENTS

| | | | |
|---|---|---|---|
| 1265486 | 5/1961 | France | 376/283 |
| 1501356 | 10/1967 | France | 376/283 |
| 1532425 | 11/1978 | United Kingdom | 376/272 |

*Primary Examiner*—Deborah L. Kyle
*Assistant Examiner*—Richard W. Wendtland
*Attorney, Agent, or Firm*—William R. Hinds

[57] ABSTRACT

A container, termed a multi-element bottle, to receive irradiated nuclear fuel is housed within a flask for transport and both the bottle and flask contain water. Ullage space within the fuel chamber in the bottle and flask allow for thermal expansion under normal conditions. Additional ullage is provided as a safety measure in accident conditions involving fire and resulting rise in temperature with consequent increase in pressure within the bottle and the flask. The additional ullage space is provided by a closed chamber (10) at one end of the bottle, the chamber (10) being closed by a wall (11) which can collapse or rupture when the pressure exterior thereof exceeds a predetermined value. The normal ullage space within the fuel chamber (7) in the bottle can be increased by providing a further chamber (20) within the bottle between the fuel chamber (7) and the closed end chamber (10) having the collapsible wall with means (25) providing communication between the fuel chamber and the further chamber.

7 Claims, 3 Drawing Figures

CONTAINER FOR IRRADIATED NUCLEAR FUEL

BACKGROUND OF THE INVENTION

The present invention concerns a container for the storage and transport of nuclear fuel, in particular irradiated nuclear fuel after it has been removed from a nuclear reactor and before the fuel is reprocessed to separate reusable nuclear fuel materials from the products of nuclear fission. Such a container generally accommodates a plurality of nuclear fuel element assemblies and for convenience is termed a multi-element bottle (MEB).

A MEB comprises an elongate cylindrical bottle closed at one end and having a removable lid at its opposite end, the lid being fitted with a seal which seats on a flange at the end of the bottle and being releasably secured to the flange by bolts. The bottle can accommodate a plurality of fuel element assemblies which can be located in compartments which allow for free circulation of cooling water whilst retaining the fuel in a criticality safe array. Typically the bottle can contain seven individual compartments but the number and arrangement of the compartments within the bottle is a matter of design choice. The bottle is contained within a flask for transport and both the bottle and the flask are filled with water. Ullage space within the bottle and the flask allow for thermal expansion of the water under normal conditions.

In the event of an accident involving fire and resulting in a rapid rise in temperature with consequent rise in pressure it is required to provide additional ullage in order to reduce the pressure within the bottle and the flask. The invention provides a bottle having additional ullage for accident conditions.

SUMMARY OF THE INVENTION

According to the present invention a multi-element bottle to receive irradiated nuclear fuel comprises an elongate vessel divided internally into at least two chambers, a first chamber having a number of compartments to receive fuel assemblies and closed by a removable lid at one end of the vessel, a second chamber constituting an ullage compartment and closed at the opposite end of the vessel by a wall, at least a part of the wall being collapsible when the pressure exterior of the second chamber exceeds a predetermined value.

DESCRIPTION OF THE DRAWINGS

The invention will be described further, by way of example, with reference to the accompanying drawings; in which.

DESCRIPTION OF THE PREFERRED EMBODIMENT

Figure 1:
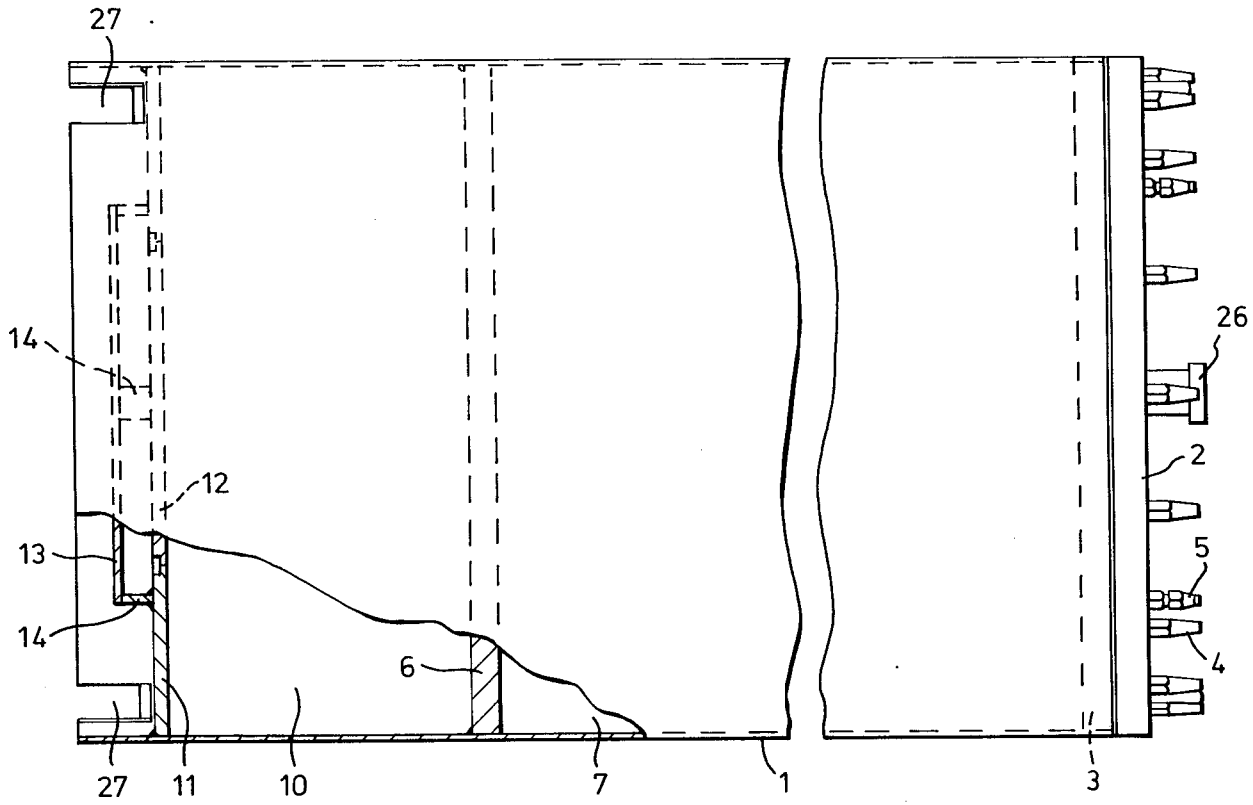
FIG. 1 is a diagrammatic elevation of a first embodiment of a multi-element bottle and with a part of the cylindrical wall thereof cut away at one end of the bottle.

In FIG. 1, multi-element bottle (MEB) comprises an elongate cylindrical vessel 1 having a removable lid 2 secured to a flange 3 at one end of the vessel by bolts 4. The vessel and the lid are conveniently formed from stainless steel. The lid is fitted with remotely operable valves 5 which permit water level adjustment and flushing operations to be performed during normal fuel handling operations.

A plate 6 is fixed permanently, as by welding, at a position spaced inwardly from the opposite end of the vessel. Chamber 7 formed between the lid 2 and the plate 6 contains a number of separate compartments 8 to receive nuclear fuel element assemblies together with neutron absorbing material. Conveniently the compartments 8 can be bounded by sheets 9 of a boron containing material and can be arranged in the form of a cruciform. The compartments are supported at one end by the flange 3 and by support plates intermediate the lid and the plate 6. The nuclear fuel element assemblies can be from a pressurised water reactor. The portion of the vessel extending beyond the plate 6 constitutes a cylindrical chamber 10 which is closed by a wall formed by a further plate 11. The chamber 10 constitutes an ullage compartment at the end of the vessel remote from the lid.

In use to transport irradiated nuclear fuel element assemblies, the MEB is submerged upright in a fuel storage pond and the fuel element assemblies are loaded, under water, into the compartments 8 within the chamber 7. The lid 2 is then secured in position and the MEB is placed within a transport flask which is also filled with water to a level to provide ullage within the flask. A required volume of ullage (air space) can be obtained witn the chamber 7 by means of a dip pipe (not shown). The ullage spaces within the bottle and the flask allow for normal expansion of the water resulting from the heat emitted by the irradiated nuclear fuel assemblies. During transport the flask and the MEB are in a substantially horizontal orientation.

The ullage within the bottle and the flask is sufficient to cater for the expansion of the water under normal conditions, that is the expansion resulting from the heat emitted by the fuel assemblies. However, in the event of an accident resulting in fire the consequent increase in temperature will produce a corresponding pressure increase within the flask and the bottle. At a certain predetermined pressure a bursting disc or discs in the lid will break to allow the water in the bottle to mix with the water in the flask. As a further safety precaution and to provide additional ullage the plate 11 will rupture or collapse at a predetermined pressure within the flask whereby the chamber 10 can accommodate the expansion of the water and thereby relieve the pressure. The plate 11, or a portion thereof, will be designed so as to rupture or collapse and release the additional ullage in the chamber 10 to thereby reduce the overall pressure within the flask and the MEB. In FIG. 1, the plate 11 is shown formed with a central region of reduced thickness constituting a bursting disc 12. The disc 12 can be protected from possible physical damage by a cover 13 supported on and spaced from the plate 11 by legs 14.

Figure 2:
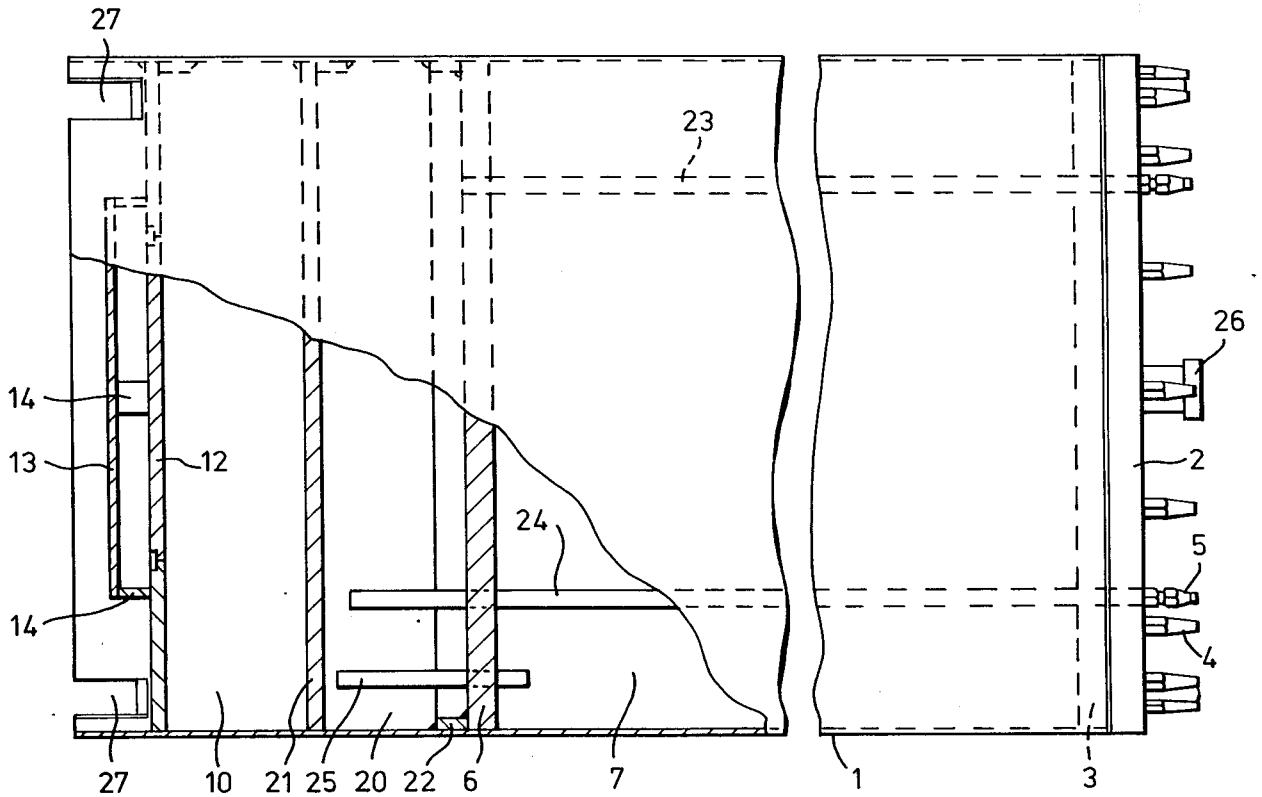
FIG. 2 is a similar elevation of a second embodiment.
Figure 3:
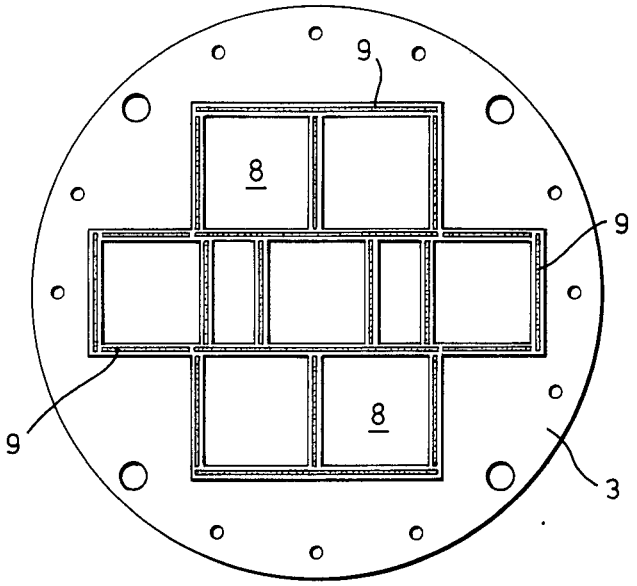
FIG. 3 is a diagrammatic end view of the bottle in FIG. 1 or FIG. 2 and with the omission of a closure lid.

The structure of the embodiment in FIG. 2 is similar to that of FIG. 1 and where appropriate the same reference numerals are used to denote corresponding parts.

In the embodiment of FIG. 2, a further ullage chamber 20 is provided between the chambers 7 and 10. The chambers 20 and 10 are separated by a plate 21. Conveniently the plate 6 can be secured to and supported by a ring 22 which is fixedly secured, by welding, to the wall of the vessel. Similar supports can be provided for the plates 11 and 21.

Pipes 23 and 24 extend between the lid 2 and the chamber 20. At the lid, the ends of the pipes 23 and 24 are secured in apertures in the flange 3 and communicate with the valves 5 on the lid. The opposite ends of the pipes 23 and 24 pass through the plate 6 and open into the chamber 20 with the pipe 24 terminating a short distance from the plate 6. A further pipe 25 provides communication between the chambers 7 and 20, this pipe 25 passing through the plate 6 at a position adjacent the periphery of the plate. The end of the pipe 25 within the chamber 20 terminates at a position closer to the plate 21 than the corresponding end of the pipe 24.

As before, the bottle is loaded under water and in an upright position. During loading of fuel into the compartments 8 within the chamber 7 water flows through the pipe 25 to fill the chamber 20. After loading the lid 2 is secured in place and water in the chamber 20 is expelled by air under pressure applied to the pipe 23 to force the water out of the chamber through pipe 24. The expulsion of water continues until the level within the chamber 20 falls below the end of the pipe 24. As the end of the pipe 25 is below the end of the pipe 24 the former is always submerged and the air introduced into the chamber through pipe 23 does not enter the chamber 7 containing the fuel assemblies. The valves 5 at the ends of the pipes 23 and 24 are closed and water within the chamber 7 can drain into the chamber 20 through pipe 25 until a balance is obtained and the trapped air volume within the chamber 20 supports the water in the chamber 7.

The bottle is lifted into a flask filled with water for transport in a horizontal position. The bottle can be lifted by means of a pintle 26 on the lid and keyways 27 at the opposite end of the vessel cooperate with keys in the flask for location of the bottle within the flask.

The chamber 20 provides additional ullage space within the bottle. Under normal conditions the ullage spaces within the compartments 6 and 20 cater for thermal expansion of the water. In any abnormal condition resulting in a rapid rise in temperature and consequential increase in pressure within the bottle the excess ullage space within the chamber 20 can relieve the pressure. As in the case of the FIG. 1 embodiment the lid is provided with a bursting disc or discs which will rupture if the pressure within the bottle exceeds a certain predetermined value to allow the water in the bottle to mix with the water within the flask and to utilise the ullage space within the flask. Finally, if the pressure within the flask exceeds a predetermined value the bursting disc 12 in the plate 11 will rupture to release the ullage space in the chamber 10.

Although not shown in the drawings further inlet and outlet pipes can extend from valves on the lid to terminate within the chamber 7 adjacent the plate 6. Such pipes can be used for flushing the chamber 7.

I claim:

1. A multi-element bottle constructed and arranged for receiving, storing and transporting irradiated nuclear fuel in water, and for housing within a water-containing flask for transport of the bottle and nuclear fuel contents, said bottle comprising an elongate vessel, means dividing the vessel internally into at least two axially spaced chambers, a first of said chambers including means forming a number of compartments constructed and arranged for receiving and storing nuclear fuel assemblies in the first chamber, a removable lid at one end of the vessel closing the first chamber, a second of said chambers constituting an ullage compartment isolated in fluid tight manner from said first chamber by said dividing means, a closure wall at the other end of said vessel closing said second chamber, at least part of said closure wall comprising means for rupturing inwardly to open said ullage compartment to the exterior of said vessel when the pressure exterior of said second chamber and acting against said closure wall exceeds a predetermined value, whereby said vessel can be housed in a water-containing transport flask and said ullage compartment is available to reduce pressure within said flask when the flask pressure, and hence the pressure external of said vessel, exceeds said predetermined value, wherein said compartments include neutron absorbing material.

2. A multi-element bottle constructed and arranged for receiving, storing and transporting irradiated nuclear fuel in water, and for housing within a water-containing flask for transport of the bottle and nuclear fuel contents, said bottle comprising an elongate vessel, means dividing the vessel internally into at least two axially spaced chambers, a first of said chambers including means forming a number of compartments constructed and arranged for receiving and storing nuclear fuel assemblies in the first chamber, a removable lid at one end of the vessel closing the first chamber, a second of said chambers constituting an ullage compartment isolated in fluid tight manner from said first chamber by said dividing means, a closure wall at the other end of said vessel closing said second chamber, at least part of said closure wall comprising means for rupturing inwardly to open said ullage compartment to the exterior of said vessel when the pressure exterior of said second chamber and acting against said closure wall exceeds a predetermined value, whereby said vessel can be housed in a water-containing transport flask and said ullage compartment is available to reduce pressure within said flask when the flask pressure, and hence the pressure external of said vessel, exceeds said predetermined value, wherein said means for rupturing comprises a preferentially weakened region of said closure wall, the preferentially weakened region constituting a bursting disk.

3. A multi-element bottle constructed and arranged for receiving, storing and transporting irradiated nuclear fuel in water, and for housing within a water-containing flask for transport of the bottle and nuclear fuel contents, said bottle comprising an elongate vessel, means dividing the vessel internally into at least two axially spaced chambers, a first of said chambers including means forming number of compartments constructed and arranged for receiving and storing nuclear fuel assemblies in the first chamber, a removable lid at one end of the vessel closing the first chamber, a second of said chambers constituting an ullage compartment isolated in fluid tight manner from said first chamber by said dividing means, a closure wall at the other end of said vessel closing said second chamber, at least part of said closure wall comprising means for rupturing inwardly to open said ullage compartment to the exterior of said vessel when the pressure exterior of said second chamber and acting against said closure wall exceeds a predetermined value, whereby said vessel can be housed in a water-containing transport flask and said ullage compartment is available to reduce pressure within said flask when the flask pressure, an hence the pressure external of said vessel, exceeds said predetermined value.

4. A multi-element bottle as claimed in claim 3 wherein said compartments are at least partially bounded by boron containing material.

5. A multi-element bottle according to claim 3 including a further chamber within the vessel and disposed between the first and second chambers and isolated in fluid tight manner from at least the second chamber.

6. A multi-element bottle according to claim 5 including a plate forming a partition between the first and further chambers and means providing communication between the first and further chambers, the communication means comprising a pipe extending through the plate, the pipe terminating adjacent a further plate forming a partition between the second and further chambers.

7. A multi-element bottle according to claim 6 including inlet and outlet conduits extending between the lid and the interior of the further chamber.

* * * * *